US006090449A

United States Patent [19]

Ferdinando et al.

[11] Patent Number: 6,090,449

[45] Date of Patent: Jul. 18, 2000

[54] SLOW-DRYING AQUEOUS-BASED COATING MATERIALS AND PAINTING TECHNIQUES FOR THE USE THEREOF

[76] Inventors: Peter G. Ferdinando, Belleville, N.J.; Theresa Wille, executrix, 53 Mitchell St., Belleville, N.J. 07109

[21] Appl. No.: 09/014,176

[22] Filed: Jan. 27, 1998

[51] Int. Cl.[7] ..... B05D 1/36

[52] U.S. Cl. ..... 427/407.2; 427/409; 427/411; 427/412

[58] Field of Search ..... 427/407.2, 409, 427/411, 412

[56] References Cited

U.S. PATENT DOCUMENTS

| | | |
|---|---|---|
| 2,250,346 | 7/1941 | Barrell . |
| 2,440,953 | 5/1948 | Iliff et al. . |
| 2,683,699 | 7/1954 | Gehring . |
| 2,802,799 | 8/1957 | Johnson . |
| 2,813,851 | 11/1957 | McKay . |
| 2,914,495 | 11/1959 | Gordon et al. . |
| 3,025,253 | 3/1962 | Mayne et al. . |
| 3,033,808 | 5/1962 | Murray et al. . |
| 3,037,881 | 5/1962 | McDowell . |
| 3,085,889 | 4/1963 | Swift . |
| 3,116,827 | 1/1964 | Gilchrist . |
| 3,374,196 | 3/1968 | Gillis et al. . |

FOREIGN PATENT DOCUMENTS

| | | |
|---|---|---|
| 812888 | 12/1997 | European Pat. Off. . |
| 53-005233 | 1/1978 | Japan . |
| 7-145289 | 6/1995 | Japan . |
| 96/03466 | 2/1996 | WIPO . |

*Primary Examiner*—Erma Cameron

*Attorney, Agent, or Firm*—Lerner, David, Littenberg, Krumholz & Mentlik, LLP

[57] ABSTRACT

Products are disclosed to be applied to a given surface to be painted in which the drying time of the product on the coated surface is delayed so as to increase the useable working time for the painting surface. The base coating products consist generally of mixtures of synthetic resin water-based paints preferably acrylic colorless or colored paints, glycerin USP 96% and water in predetermined ratios by weight. The synthetic resin water-based paint as an ingredient when colorless provides a colorless base coating composition and, when colored, provides a colored base coating composition. The enumerated coating compositions may also include, in predetermined ratios, small quantities of surfactants and/or thickening agents which enhance the purpose and object of the enumerated coating compositions for delaying the drying time so as to increase the time during which the coated surface can be worked by applying, blending and overcoating the base coated surface with synthetic resin water base paints. Also illustrated is a method or process of "wet on wet" painting technique consisting of formulating the particular base coating compositions desired, coating this particular base coating composition on at least one a portion of the given painting surface and creating and overcoating the base coated painting surface by applying and working water-based paints so long as the base coated painting surface remains wet and workable. Additionally, a painted surface with a base coating composition as the undercoating and an applied overcoating thereon consisting of synthetic resin acrylic paints. Additionally, an emollient to be mixed or stirred with a synthetic resin acrylic or water-based paint in relatively small quantities before using the paint, to delay the drying time thereof, has as its principal ingredient a humectant preferably glycerin USP 96%.

11 Claims, No Drawings

SLOW-DRYING AQUEOUS-BASED COATING MATERIALS AND PAINTING TECHNIQUES FOR THE USE THEREOF

This invention relates generally to slow-drying aqueous or water-based coatings and paints and more particularly to slow-drying aqueous-based coating compositions including synthetic resin acrylic paints and the use of such compositions for improved "wet on wet" painting techniques.

BACKGROUND OF THE INVENTION

When used herein, "wet on wet" refers to a painting technique in which the drying times of the coating compositions and/or the paints applied to a canvas or other surface being painted or on which an artist is working to create a painting are delayed so as to extend the time during which the surface can be satisfactorily and creatively worked to obtain the result desired by the painter or artist.

Heretofore this technique has only been used successfully by artists using oil-based coating compositions and paints. This, however, has limitations because oil-based coating compositions and paints, particularly when used indoors, have strong and sometimes unpleasant odors and additionally are hazardous because of the solvents used in such oil-based coating compositions and paints.

Aqueous or water-based coating compositions or paints for use in such "wet on wet" painting techniques present difficulties because of their rapid drying characteristics coupled with the normal formation of a film or skin on the composition after it is coated on a surface, particularly where the coating has a thickness such that the film dries while the undercoating remains liquid or wet. Those skilled in the art will recognize that the drying of such aqueous or water-based paints occurs because of a phase reversal from liquid to solid of the applied coating material upon loss of water in the composition generally by evaporation and the agglomeration of the polymer particles of the water-based composition into a coherent film. In the case of a thicker coating of the water-based composition, this occurs first at the surface. This phase change from a continuous water phase to a continuous solid phase is a physical reaction which is generally irreversible. Therefore, it impedes the ability to further work the surface to which such paint compositions have been applied.

Slow-drying water-based coating compositions are known, such as is shown and disclosed in U.S. Pat. No. 3,374,196. In this patent a wide variety of water-based natural rubber latex coating compositions are identified and the difficulties due to rapid drying and skin formation due to the thickness of the latex compositions when applied to a surface are overcome by additives to the latex compositions that retard the rate of drying and of skin formation. The particular additive identified is a combination obtained from a physical mixture of urea and a non-polymeric water soluble glycol, such as glycerin, ethylene glycol or sorbitol. When this additive is combined with the latex compositions in the manner disclosed, a paste-like latex composition is formed which has the same rheological properties as conventional artists' oil paints. A preferred additive mixture consists of one part by weight of urea and one part by weight of glycerin formed by heating the glycerin to 250° F. and dissolving the urea therein, in the form of urea pills, until the urea is fully dissolved. This specific additive delays the drying time of the paste-like natural rubber latex composition to which it is added but only about twenty (20) minutes.

Pat. '196 makes it clear that there is some synergistic effect between the urea and the glycerin for delaying drying time of the natural rubber latex composition vehicle to which they are added because this patent specifically states that such delay in drying time cannot be achieved by either of these ingredients separately. The same effect was found to apply for other normal humectants such as ethylene glycol, propylene glycol and the like.

In the present invention, contrary to U.S. Pat. No. 3,374,196, it has been found that by adjusting the ratio of glycerin, or the ratio of glycerin and other additives to a synthetic resin water-based composition such as an acrylic paint or coating material, results in the formation of a synthetic resin acrylic composition with material and substantial delays in the drying time of such synthetic resin water-based or acrylic compositions to the extent that when such improved synthetic resin acrylic compositions are coated on and worked into a surface on which a painting is being made, these substantial delays in drying time of the coating applied to the surface extend the working time for water-based paints overcoated onto the base coated surface and thus enable the painter or artist to achieve advantages or necessary painting changes and finishes on the coated surface. In this regard, not only is it possible to provide synthetic resin water-based acrylic coating compositions, but also improved paste-like synthetic resin water-based acrylic compositions, each with their respective delay in drying time for achieving these advantageous results and characteristics. However, these respective delays in drying time, as will be clear from the examples set forth hereinafter, are at least in the order of forty (40) hours or more and thus provide extended working time for overcoating the base coated surface being painted. Thus, these synthetic resin acrylic coating compositions serve well as undercoatings and are adapted to be used synergistically with either regular commercial acrylic paints or with the improved synthetic rubber paste-like acrylic compositions in accordance with the present invention to meet the requirements for use in "wet on wet" painting techniques by artists, particularly those who wish to paint indoors as well as elsewhere.

Acrylic, when used herein, is a designation for a series of colorless olefin pungent acids obtained from the oxidation of acrolein having the general formula $C_nH_{2N}O_2$.

Acrylic paints or coating compositions are any of a group of thermoplastic synthetic resins formed by polymerizing esters of acrylic acid or methylacrylic acid. These materials are different and distinguishable from alkyd resins and natural rubber latex materials.

Any acrylic materials as above identified may be used in the formation of the improved acrylic compositions in accordance with the present invention. Such acrylic materials and other ingredients of these improved formulations are purchasable in the commercial marketplace or are readily available. These ingredients for such improved formulations may consist of one or more of the following:

- Pébéo™ Acrylic Clear Paint
- Pébéo™ Acrylic White Paint, Extra Fine Color 118 Series 1, Blanc de Titane
- A humectant such as Glycerin USP 96% which has an affinity for water with stabilizing action on the water content of a material and keeps the moisture content caused by humidity within a narrow range
- Acrylic Flow Improver—a concentrated solution of wetting agent
- Pébéo™ Acrylic Gel—a thickening agent These may be used and mixed in the improved formulations of the acrylic compositions in accordance with the present invention in ratios either by volume or by weight.

Thus, the general steps for the formulation of the aqueous coating compositions or paint formulations, to provide a better understanding of the invention, will now be illustrated by reference to the following examples.

EXAMPLE 1

In early afternoon at an ambient temperature of 70° F. and relative humidity of 50%, full-strength glycerin was coated on the surface of a canvas, and the surface of the canvas was checked for wetness every hour after the surface was coated. After fourteen (14) hours the surface of the canvas was still wet; however, the appearance of the surface was blotchy, streaky and pebbly-looking. While the full-strength coating with just glycerin kept the surface of the canvas wet, the performance as an undercoating for the "wet on wet" painting technique was rated as poor.

EXAMPLE 2

In early afternoon at an ambient temperature of 70° F. and relative humidity of 50%, an acrylic composition consisting of:

8½ oz. or 1½ parts by volume of acrylic white,

9½ oz. or 1½ parts by volume of glycerin and

3¾ oz. or ¾ parts by volume of tap water was mixed together, stirred and shaken well for a period of at least three (3) minutes.

This mixture was applied by a brush and worked into a canvas to provide a white coating base on the surface of the canvas. Using the "wet on wet" painting technique, a portion of this white base coated surface on the canvas was overpainted with conventional acrylic colored paints. These paints were applied and blended well onto the wet acrylic white base coated on the surface of the canvas. The remaining portion of the white base coating on the surface of the canvas was checked hourly, and over forty (40) hours after the white base coating had been applied, this remaining portion of the coated surface of the canvas was still wet.

Thus, this mixture achieved the purpose and objects of the present invention for "wet on wet" painting techniques.

EXAMPLE 3

In early afternoon at an ambient temperature of 70° F. and humidity of 50%, an acrylic composition consisting of:

2 oz. of Pébéo™ Acrylic Clear, 10 oz. of glycerin and 6 oz. of tap water was mixed together, stirred and shaken well for a period of at least three (3) minutes.

This clear coating mixture was applied by brush and worked into the surface of a canvas. The coated base composition on the surface of the canvas material was checked every hour after it was coated. After forty (40) hours the coating on the canvas was still wet. The appearance of the mixture coated on the surface of the canvas had a smooth and even texture. This mixture has the properties for excellent performance for use in the "wet on wet" painting technique.

EXAMPLE 4

In late afternoon at an ambient temperature of 70° F. and relative humidity of 60%, an acrylic composition consisting of:

2 oz. of Pébéo™ Acrylic Clear, 12 oz. of glycerin and 4 oz. of tap water was mixed, stirred and shaken together for about three (3) minutes.

This mixture was brushed onto the surface of a canvas and provided a clear base coated surface on the canvas. The coated surface on the canvas was checked every hour after it was coated. During the same time frame a portion of the coated surface on the canvas was overpainted with conventional acrylic paints. The colors of the acrylics used for overpainting applied well and blended well, which could not be done to the canvas without the base undercoating of this acrylic composition mixture. After some sixty (60) hours, a check of the portion of the coated canvas which had not been overpainted was still wet, and the appearance of the coated composition had a smooth even texture, but fuller in appearance than the composition of EXAMPLE 3. The performance for "wet on wet" painting technique was only fair.

EXAMPLE 5

In late afternoon at an ambient temperature of 70° F. and relative humidity of 60%, an acrylic composition consisting of:

2 oz. of Pébéo™ Acrylic White, 10 oz. of glycerin and 4 oz. of tap water was mixed and stirred together for about three (3) minutes.

This mixture was brushed onto the surface of a canvas and provided a white base coating on the surface of the canvas; the coated surface of the canvas was checked every hour after it was coated. During this same time frame a portion of the canvas that had been coated was overpainted with conventional acrylic paints. The colors of the acrylics used for overpainting applied and blended well, which could not be done to the canvas without the base undercoating of this acrylic composition mixture. After some sixty (60) hours, a check of the portion of the coated canvas which had not been overpainted was still wet, and the appearance of the surface with this white base coated composition had a smooth even texture, although the coating had some lumps; nonetheless, it served well for painting in accordance with the "wet on wet" painting technique. The performance for "wet on wet" was good but a smoother mixture was needed such as the mixture provided by EXAMPLE 3.

EXAMPLE 6

In the late afternoon at an ambient temperature of 70° F. and relative humidity of 50%, an acrylic composition of:

2 oz. of tap water and 2 drops (minims) of Acrylic Flow Improver (concentrated wetting agent) were mixed, stirred and shaken for one (1) minute;

1 oz. of Pébéo™ Acrylic White was added, and this mixture was then stirred and shaken for about one (1) minute; then 5 oz. of glycerin was added to this second mixture, stirred and shaken for about one (1) minute.

This mixture was then brushed and worked into a portion of a canvas to provide a white base coating on the surface of the canvas. Shortly thereafter, portions of this coated surface of the canvas was painted with conventional orange-colored, yellow-colored, white-colored and blue-colored acrylic paints. These paints blended well into the coated surface of the canvas. The unpainted undercoating on the canvas was checked hourly, and forty (40) hours after the canvas had been coated, the coating was still wet. The performance for "wet on wet" painting with water-based paints was good.

EXAMPLE 7

In the late afternoon at an ambient temperature of 70° F. and relative humidity of 50%, an acrylic composition of:

1 oz. of tap water and 2 drops (minims) of Acrylic Flow Improver (concentrated wetting agent) were mixed, stirred and shaken for one (1) minute;

1 oz. of Pébéo™ Acrylic White was added, and this mixture was then stirred and shaken for about one (1) minute; and ½ oz. of Acrylic Gel was added to this second mixture, then stirred and shaken for about one (1) minute; then 1½ oz. of glycerin was added to this third mixture, stirred and shaken for about one (1) minute.

This mixture thus formulated was then brushed and worked into a canvas to provide a white base coating on the surface of the canvas. Two (2) hours after the canvas had been coated, the base coating was still wet. Thereafter, portions of this coated surface of the canvas was painted with conventional orange-colored, yellow-colored, white-colored and blue-colored acrylic paints. These paints blended well into the coated surface of the canvas. The unpainted undercoating on the canvas was checked hourly, and after sixty (60) hours, this base coating on the surface of the canvas with the mixture as above formulated was still wet. The performance for "wet on wet" painting with water-based acrylic paints was considered excellent.

EXAMPLE 8

In the late afternoon at an ambient temperature of 70° F. and relative humidity of 50%, an acrylic composition of:

2 oz. of tap water and 2 drops (minims) of Acrylic Flow Improver (concentrated wetting agent) were mixed, stirred and shaken for one (1) minute;

2 oz. of Pébéo™ Acrylic White was added, and this mixture was then stirred and shaken for about one (1) minute; then 2 oz. of glycerin was added to this second mixture, stirred and shaken for about one (1) minute thereafter;

2 oz. of Pébéo™ Acrylic Gel was added to this third mixture, stirred and shaken for about one (1) minute.

This mixture was then brushed and worked into a portion of a canvas to provide a white base coating on the surface of the canvas. Shortly thereafter portions of this base coating on the canvas was painted with conventional orange-colored, yellow-colored, white-colored and blue-colored acrylic paints. These paints blended well into the coated surface of the canvas. Approximately one (1) hour after the canvas had been coated with the mixture as above formulated, I overpainted the canvas with a seascape wing white, blue, yellow, orange, pink, paynes grey, brown and black conventional acrylic colored paints. The colors blended well, the mixture was smooth, and the performance for "wet on wet" painting was excellent.

The unpainted portions of the undercoating on the canvas was checked hourly and was still wet over seventy-two (72) hours after the canvas had been coated.

EXAMPLE 9

In the late afternoon at an ambient temperature of 70° F. and relative humidity of 50%, an acrylic composition of:

4 oz. of tap water and 2 drops (minims) of Acrylic Flow Improver (concentrated wetting agent) were mixed, stirred and shaken for one (1) minute;

4 oz. of Pébéo™ Acrylic White was added, and this mixture was then stirred and shaken for about one (1) minute; then 6 oz. of glycerin was added to this second mixture, stirred and shaken for about one (1) minute thereafter;

½ oz. of Pébéo™ Acrylic Gel was added to this third mixture, stirred and shaken for about one (1) minute.

This mixture was then brushed and worked into a portion of a canvas to provide a white base coating on the surface of the canvas. Shortly thereafter portions of this base coating on the canvas was painted with conventional orange-colored, yellow-colored, white-colored and blue-colored acrylic paints. These paints blended well into the coated surface of the canvas. Approximately one (1) hour after the canvas had been coated with the mixture as above formulated, I overpainted the canvas with a seascape wing white, blue, yellow, orange, pink, paynes grey, brown and black conventional acrylic colored paints. The colors blended well, the mixture was smooth, and the performance for "wet on wet" painting was excellent.

The unpainted portions of the undercoating on the canvas was checked hourly and was still wet over sixty (60) hours after the canvas had been coated.

From the above examples certain conclusions can be drawn. First, a base coating of 100% standard USP glycerin will maintain the surface to be painted wet for many hours but will not serve as a base coating for the "wet on wet" painting technique because it does not have the appearance or the texture needed to apply and blend conventional acrylic colored paints to such glycerin coated surface. Second, a good composition to provide a clear base undercoating on a surface to be painted can be formulated from Pébéo™ acrylic clear, glycerin and tap water wherein the optimum mixture of these ingredients is in a ratio of 11 to 55 to 33 by weight. This ratio can be varied to also provide good mixtures for this purpose by adjusting the ratio of glycerin between 62 and 55 by weight with tap water between 37 and 33 by weight. Third, a good composition to provide a colored base undercoating on a surface to be painted can be formulated from Pébéo™ acrylic white, glycerin and tap water where the optimum mixture of these ingredients is in a ratio of 27 to 41 to 27 by weight. As in the clear base undercoating mixture, these ingredients can be varied by adjusting the ratio of the glycerin and the tap water. Fourth, the mixture can be further enhanced to delay drying and to increase working time for the application of acrylic colored paints by adding small quantities of wetting agents and/or thickening agents to the above defined ratios of these mixtures. These variations can also serve as a means for formulating acrylic paints which have delayed drying time. Thus, in accordance with the present invention many synthetic resin water-based compositions are capable of formulation which can be used synergistically with the mixtures defined above for the base coatings on a surface to be painted without departing from the scope of the present invention.

Further, it is noted that the examples show that the various illustrated synthetic resin base coating compositions were brushed into or on the surfaces being coated. This technique was used as the preferred method in these examples in order to limit the thickness of the base coating applied to the surface to be overcoated with further synthetic resin water-based paints and thus to avoid the film or skin drying effect on the surface of the base coat to defeat the object and purpose of the present invention namely to delay the drying of the base coating on the surface being painted so that the coated surface remains wet and can be worked by the painter or artist a substantial period of time to modify and achieve greater creativity.

To illustrate such limitations on film or skin formation, it was established that a gallon of any of the variations of base compositions illustrated in the above examples will cover 450 sq. ft. or 0.28444 of an ounce per square foot. Thus, on a canvas or other surface to be painted of 16" by 20" which is 2.1875 sq. ft. the total weight of the applied base coating composition will be 0.6222 of an ounce. Thus, one type of an uncoated 16"×20" canvas surface was measured and found to weigh 17 ounces. When this canvas surface was coated, it weighed 18.25 ounces wet. After drying the canvas weighed 17.64 ounces. Thus the weight of the coating was 0.29257 ounces per sq. ft. A coating with this weight per square foot provided a thickness to the base coatings in a range from ½ mil to approximately 2 mils and a preferred range of ½ mil to 1 mil. This weight and range of thickness prevented the film or skin drying effect from occurring on the base coatings applied to a given surface being painted and thus did not interfere with the delay in drying time of any base coatings applied to a surface to be painted.

Accordingly, the quantities of paint, humectant and water must be selected to obtain a viscosity effective to provide a coating of this desired thickness. This can be determined by one of ordinary skill in the art without. undue experimentation.

Thus synthetic resin water-based compositions have been illustrated which overcome the problems of the prior art regarding the adverse effect of odors, solvents and the formation of dry films or skins particularly adapted for use in "WET on WET" painting techniques for synthetic resin water-based paints as will now be further described.

"WET ON WET" PAINTING TECHNIQUE FOR SYNTHETIC RESIN WATER-BASED PAINTS

In using any of these water-based coating compositions to achieve the desired "wet on wet" painting technique, the canvas or other surface being painted is first preferably completely coated with either, or a combination of either, the clear form of the water-based coating composition or the colored form of the water-based coating composition in the approximate weight and thickness, all as above described and as may be required for the particular work being made or performed on the given surface being painted.

After the canvas has been coated, the coated surface serves as an undercoating, and so long as the coated surface remains "wet", the painter or artist can apply either conventional paints or modified paste-like paint formulations as hereinafter described, and work and blend these overcoatings onto the coated surface of the canvas or other surface on which the painting is being performed.

Modified Paste-Like Paint Formulations

Conventional off-the-shelf Synthetic Resin Acrylic and other water-based paints having a drying time of about thirty (30) minutes or less depending on the film or skin formation, the ambient conditions and the nature of the surface being painted. This limits the usable working time of such paints.

As another aspect of the present invention, it has been found that the working time of conventional off-the-shelf synthetic resin acrylic and water-based paints can be materially extended by delaying such drying time by adding thereto limited quantities of an emulsion having, as a basic ingredient, a humectant, preferably the glycerin USP 96%. When these off-the-shelf paints are so modified, they can be used directly on a given surface to be painted when only a short period of delay in the drying time of the applied paint is required or they can be applied and worked onto a surface to be painted having a base or undercoating of one or more of the base coating compositions, as are illustrated in the examples set forth above, where a greater delay in the drying time is desired or required by the painter or artist.

EXAMPLE 10

One such emulsion was made in the early evening at an ambient temperature of 70° F. and relative humidity of 50% by hand mixing or stirring together on a palette:

1½ oz. of an off-the-shelf conventional acrylic green paint, and 5 drops (minims) of glycerin USP 96% containing 0.01% by volume of a surfactant, sodium lauryl sulfate.

This mixture was applied to a first section of a canvas painting surface having one of the base coating compositions as above described. The unmodified conventional off-the-shelf acrylic green paint was applied to a second section of this coated canvas painting surface. These respective sections of the coated canvas painting surface were monitored and checked from time to time for wetness.

It was determined from the monitoring that the section of the coated painting canvas dried in about five (5) hours. It was further determined that the modified off-the-shelf acrylic green paint as above described over ten (10) hours and therefor had a working time or remained wet greater than 100% than the working or drying time of the conventional off-the-shelf acrylic green paint.

Thus a still further means for controlling drying time for use in the wet on wet painting technique is provided with the use of such modified conventional off-the-shelf synthetic acrylic or water-based paints when applied to surfaces to be painted which are undercoated with one of the base coating combinations as described herein.

Those skilled in the art will readily recognize that synthetic resin water-based paints or the like coating compositions having the same or similar composition to the acrylic paints identified in the examples may also achieve the same advantageous results, The present invention also contemplates the manufacture of synthetic resin water-based paint products for the commercial marketplace having extended or delayed drying time in which conventional off-the-shelf formulations are modified by the addition of quantities of water and humectant effective to at least double the drying time of such formulations.

While only a few examples of synthetic resin water- or aqueous-based coating compositions or paint formulations are described above to illustrate the invention, it will be apparent that many different modifications and equivalents may be made without departing from the spirit and scope of the present invention. Therefore, the invention is not intended to be limited thereby, except as defined by the appended claims.

What is claimed is:

1. A wet on wet painting technique, comprising the steps of:

a. formulating a base coating composition including a synthetic resin water-based paint, a humectant, and water to provide a base coating composition, b. coating at least a portion of a painting surface with said base coating composition, and c. applying at least one water-based paint to said base coated painting surface.

2. The wet on wet painting technique of claim 1 wherein said base coating composition is colored.

3. The wet on wet painting technique of claim 2 wherein said colored base coating composition is white.

4. The wet on wet painting technique of claim 1 wherein said base coating composition is colorless.

5. The wet on wet painting technique of claims 1, 2 or 4 wherein said base coating composition is coated onto said painting surface to a thickness of up to 2 mils.

6. The wet on wet painting technique of claims 1, 2 or 4 further comprising the steps of:

a. modifying said water-based paint by the addition of a humectant thereto before applying said water-based paint to said coated painting surface.

7. The wet on wet painting technique of claim 6 wherein said water-based paint is an acrylic paint.

8. The wet on wet painting technique of claims 1, 2 or 4 wherein said humectant is glycerin.

9. The wet on wet painting technique of claim 3 wherein said white colored base coating composition is obtained by using an acrylic extra fine blanc de titane as said synthetic resin water-based paint.

10. The wet on wet painting technique of claim 1, wherein said synthetic resin water-bated paint is an acrylic paint.

11. The wet on wet painting technique of claim 1, wherein said water-based paint is an acrylic paint.

* * * * *

UNITED STATES PATENT AND TRADEMARK OFFICE

CERTIFICATE OF CORRECTION

PATENT NO. : 6,090,449

DATED : July 18, 2000

INVENTOR(S) : Ferdinando et al.

It is certified that error appears in the above-identified patent and that said Letters Patent is hereby corrected as shown below:

Col. 10, line 2, "bated" should read --based--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*